US011964733B2

(12) United States Patent
Griggs et al.

(10) Patent No.: US 11,964,733 B2
(45) Date of Patent: Apr. 23, 2024

(54) STORAGE DEVICE FOR OVERBOARD SUSPENSION OF AN ITEM ON A PLEASURE CRAFT

(71) Applicant: Gareth Neale Griggs, Boca Raton, FL (US)

(72) Inventors: Gareth Neale Griggs, Boca Raton, FL (US); Robert James Griggs, Kyalami (ZA)

(73) Assignee: Gareth Neale Griggs, Boca Raton, FL (US)

( * ) Notice: Subject to any disclaimer, the term of this patent is extended or adjusted under 35 U.S.C. 154(b) by 590 days.

(21) Appl. No.: 17/168,963

(22) Filed: Feb. 5, 2021

(65) Prior Publication Data

US 2021/0237831 A1 Aug. 5, 2021

(30) Foreign Application Priority Data

Feb. 5, 2020 (ZA) ..... 2020/00736

(51) Int. Cl.
*B63B 25/00* (2006.01)

(52) U.S. Cl.
CPC ..... *B63B 25/004* (2013.01)

(58) Field of Classification Search
CPC ..... B63B 25/004; B63B 29/00
USPC ..... 410/85
See application file for complete search history.

(56) References Cited

U.S. PATENT DOCUMENTS 1,757,490 A * 5/1930 Tibbetts ..... B62B 5/0083 410/85
3,183,875 A * 5/1965 Russell ..... E02B 3/26 114/219
3,716,938 A * 2/1973 Ammons ..... A01K 97/05 383/7
5,165,198 A * 11/1992 Kilian, III ..... A01K 97/05 383/41
5,226,576 A * 7/1993 Ellsworth ..... B60R 7/043 224/570
5,605,112 A * 2/1997 Schuman ..... B63C 13/00 224/406
5,970,652 A * 10/1999 Hohmann ..... A01K 97/20 383/7
6,105,305 A * 8/2000 Edens ..... A01K 97/20 224/406

(Continued)

FOREIGN PATENT DOCUMENTS

EP 925998 A2 * 6/1999 ..... B60N 3/004
FR 2935318 A1 * 3/2010 ..... B60R 5/003

(Continued)

*Primary Examiner* — Hilary L Gutman
(74) *Attorney, Agent, or Firm* — NIXON & VANDERHYE

(57) ABSTRACT

A device for overboard storage from a pleasure craft of an item, includes: a holder which has a first surface and a second surface and which is defined between a first side, a second side and a pair of side edges and which is moveable from an inoperative position to an operative position. An attachment element is engaged to the holder at or towards first edge and which is adapted to attach the holder to an edge (gunwale) of the pleasure craft. A harness is engaged to the holder, and is adapted to circumscribe the item, when the holder is in the operative position and the item engages the holder on the first surface, to retain the item on or within the holder.

8 Claims, 4 Drawing Sheets

(56) References Cited

U.S. PATENT DOCUMENTS

| | | | | |
|---|---|---|---|---|
| 7,350,681 | B2 * | 4/2008 | Polburn | B60R 7/005 296/37.16 |
| 7,721,667 | B2 * | 5/2010 | Kaemmerling | B63B 59/02 114/219 |
| 8,371,548 | B1 * | 2/2013 | Bishop | A45C 5/045 224/406 |
| 8,960,477 | B1 * | 2/2015 | Bishop | B63B 17/00 224/579 |
| 9,113,686 | B1 * | 8/2015 | Bishop | B63B 17/00 |
| 2004/0155080 | A1 * | 8/2004 | Fialla-Dori | B60R 7/043 297/188.2 |
| 2004/0262345 | A1 * | 12/2004 | Polburn | B60R 7/005 224/282 |
| 2008/0230501 | A1 * | 9/2008 | Gray | A47B 46/005 211/134 |
| 2014/0042781 | A1 * | 2/2014 | Reeves | B60R 7/043 297/163 |
| 2015/0230424 | A1 * | 8/2015 | Hartelius | B60R 22/10 248/505 |
| 2016/0214690 | A1 * | 7/2016 | Bires | B63B 29/04 |
| 2022/0111933 | A1 * | 4/2022 | Chiafos | B63B 25/18 |

FOREIGN PATENT DOCUMENTS

| | | | | |
|---|---|---|---|---|
| FR | 3089920 | A1 * | 6/2020 | B60R 7/005 |
| WO | WO-2008023987 | A1 * | 2/2008 | F16L 1/20 |

* cited by examiner

STORAGE DEVICE FOR OVERBOARD SUSPENSION OF AN ITEM ON A PLEASURE CRAFT

This application claims priority to ZA Patent Application No. 2020/00736 filed Feb. 5, 2020, the entire contents of which is hereby incorporated by reference.

BACKGROUND OF THE INVENTION

The invention relates to a device for overboard storage from a pleasure craft of an item.

Most pleasure boat operators spend a lot of time with their boats at anchor or under idle power, cruising inland waterways and ocean coast line or in the shallows by sandbars and the like whilst the occupants fish, socialise and swim. During these periods of non-high speed travel, cooler boxes, tackle boxes and other containers which are on board tend to create considerable clutter on deck. Even cooler boxes which are "built-in" under the seats of the boat become difficult to access with frequency, especially so when there are people sitting on these seats.

The present invention at least partially addresses the aforementioned problem.

SUMMARY OF INVENTION

The invention provides a device for overboard storage from a pleasure craft of an item, which device includes:

a holder which has a first surface and a second surface and which is defined between a first side, a second side and a pair of side edges and which is moveable from an inoperative position to an operative position;

an attachment element engaged to the holder at or towards to first edge and which is adapted to attach the holder to an edge (gunwale) of the pleasure craft; and a harness engaged to the holder;

wherein the harness is adapted to circumscribe the item, when the holder is in the operative position and the item engages the holder on the first surface, to retain the item on or within the holder.

The storage device may include a cushioning device, engaged to, or integral with, the holder and positioned to provide a cushion between the second surface of the holder, when in the operative position, and a side wall of the pleasure craft.

Preferably, the cushioning device is an inflatable device. More preferably, the inflatable device may be adapted to take on a wedge-shaped configuration when inflated to fill a complementary shaped void between the holder and the side wall of the pleasure craft.

The holder may have a flexible or a rigid body.

In the one embodiment, the holder has a flexible body comprised of a sheet or a net of a flexible material. The flexible material may be any suitably durable natural, synthetic or composite material. The material may be woven, knitted or matted to provide the sheet or net.

The holder may include a rigid mounting element which provides a means through or to which the attachment element engages to attach the holder to the edge of the pleasure craft, whilst also holding the holder open in lateral extension. Preferably, the element extends along the first side. More preferably, the element is engaged with the holder by sliding into a pocket formed along the first side.

The attachment element may include at least one plug, pin or peg. The at least one peg may be adapted to engage a respective rod holder aperture on a perimeter of the pleasure craft.

The extension element may include an aperture to receive the plug.

In the alternative, the holder has a rigid body comprised of at least a first panel and a second panel, joined along an axis.

In the inoperative position, the panels may be folded or in planar extension, in the operative position, the second panel may rotate about the axis to project perpendicularly from the first panel.

The first and the second panels may be made of a suitably rigid plastics, composite or metal material. Each panel may be a solid or a latticed panel.

The harness may be a length adjustable belt and buckle such as, for example, a belt with a cam buckle, to adjust the length of the harness which circumscribes the item.

Each end of the harness may engage a respective side edge of the holder to extend across the harness.

BRIEF DESCRIPTION OF THE DRAWINGS

The invention is further described by way of examples with reference to the following drawings in which.

DESCRIPTION OF PREFERRED EMBODIMENTS

Figure 1:
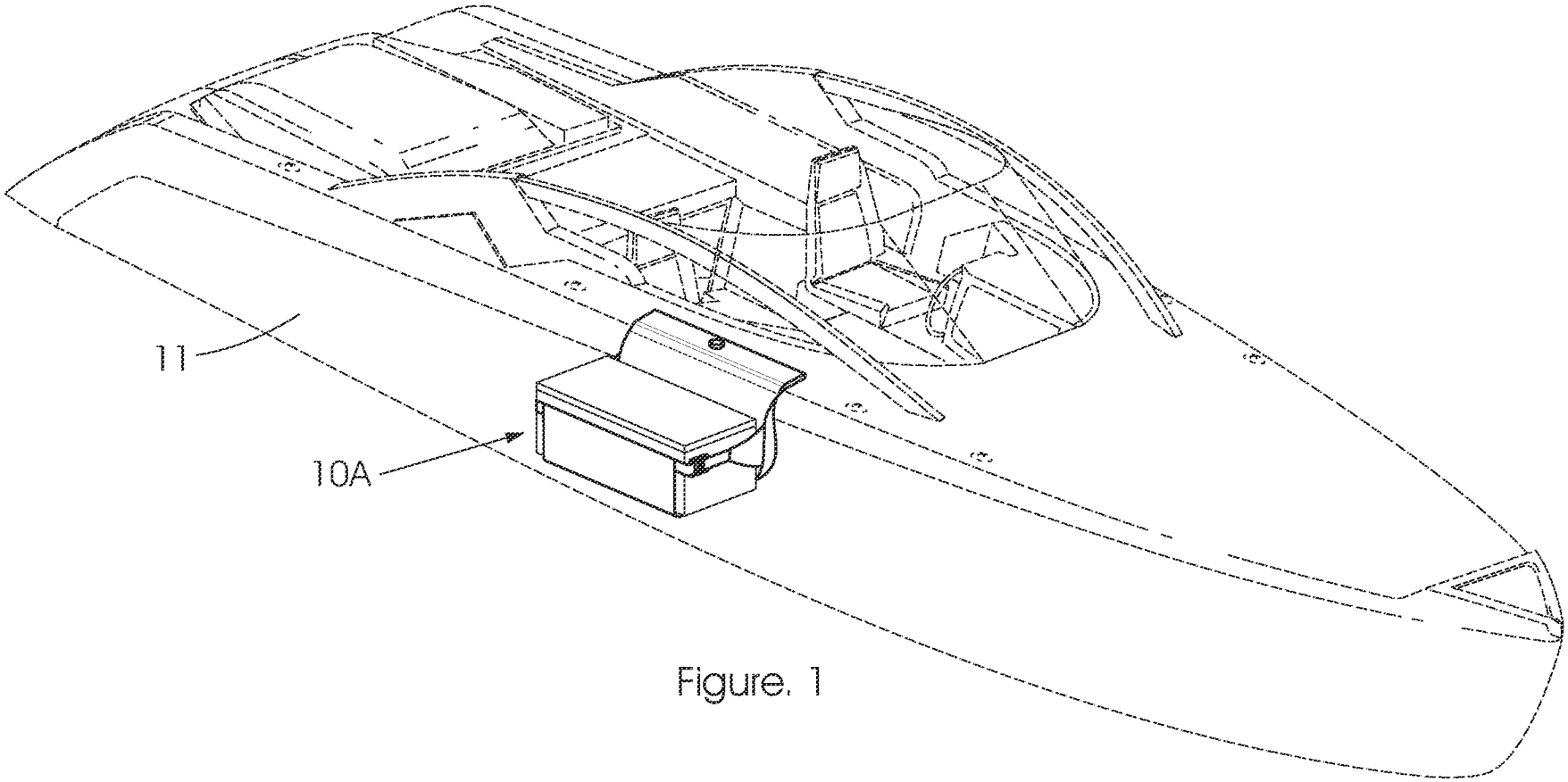
FIG. 1 illustrates a pleasure boat with a storage device, in accordance with a first embodiment of the invention, suspended over a side of the boat.

FIG. 1 illustrates a device 10A for overboard storage from a pleasure craft of an item (hereinafter "a storage device") in accordance with a first embodiment of the invention, engaged with a pleasure craft such as a boat 11 to suspend over a side of the boat.

Referring to FIGS. 2A to 4, the storage device 10A includes a holder 12 which has a body 13 which, in this example, is a rectangular sheet of a durable flexible non-abrasive material, such as canvas or the like, an attachment element 14 and a harness 16.

Figure 2A:
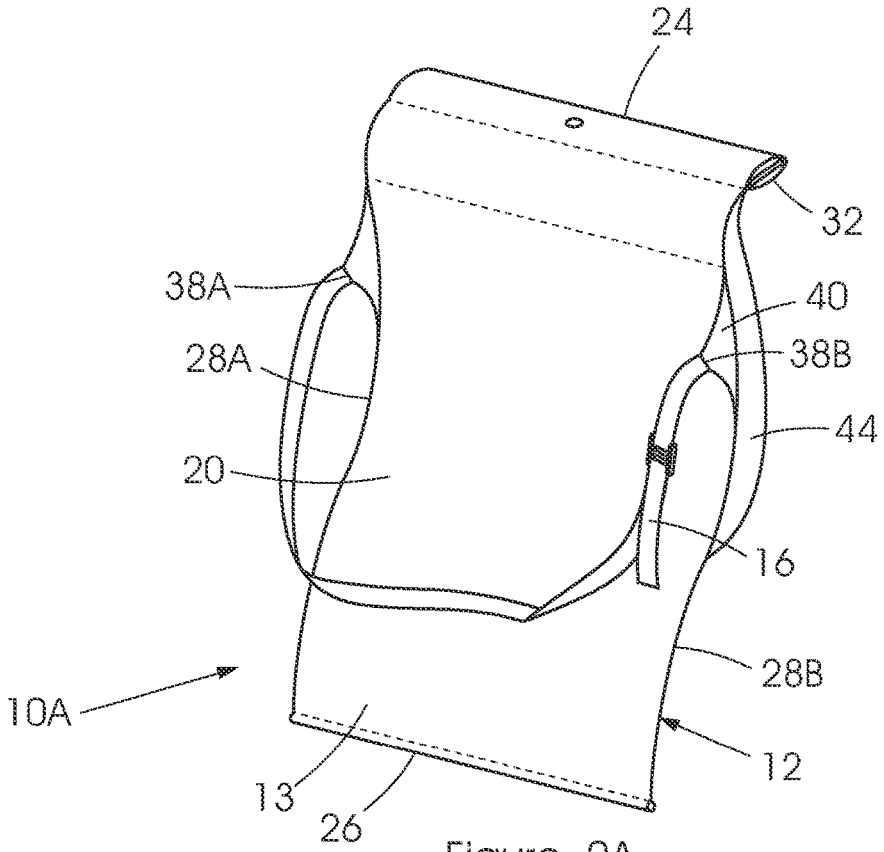
FIGS. 2A and 2B illustrate, in perspective, the storage device of the first embodiment in an inoperative (FIG. 2A) and operative (FIG. 2B) position.
Figure 2B:
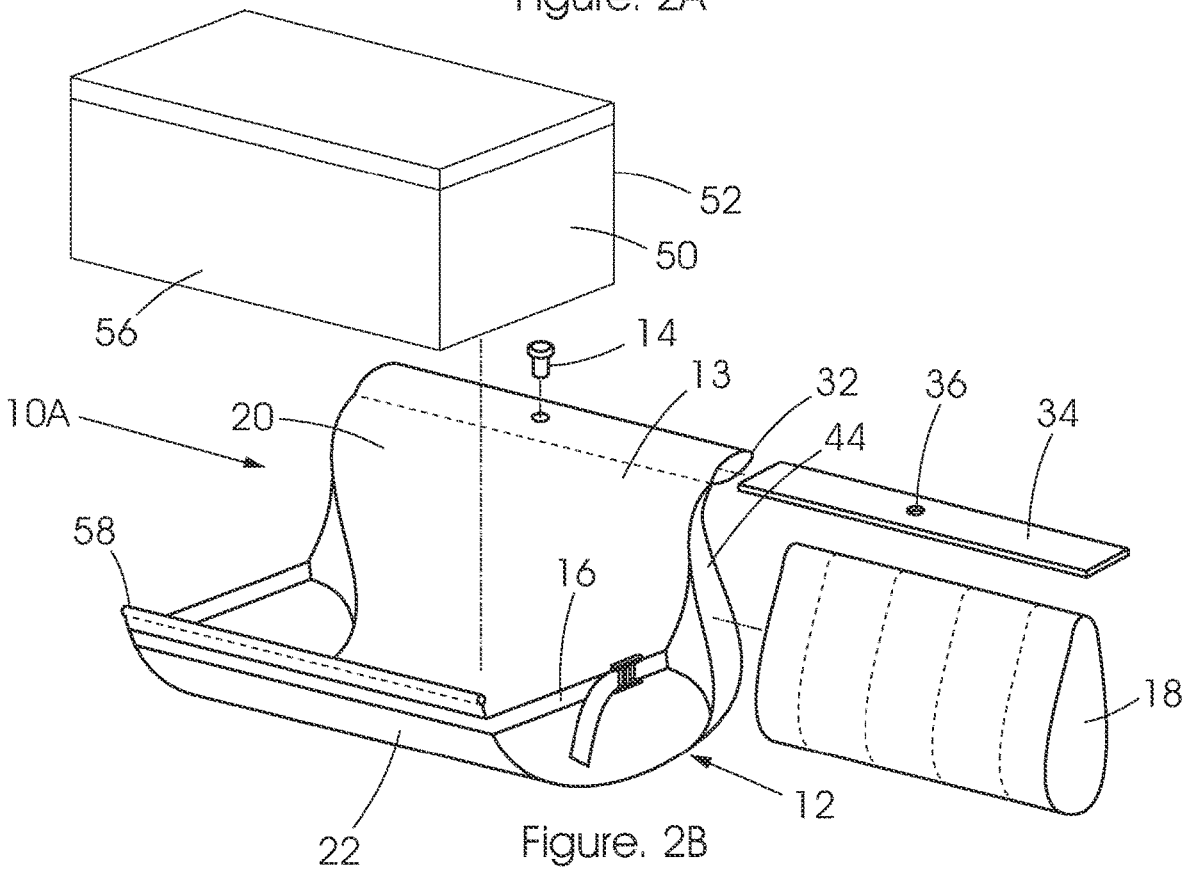
Figure 3:
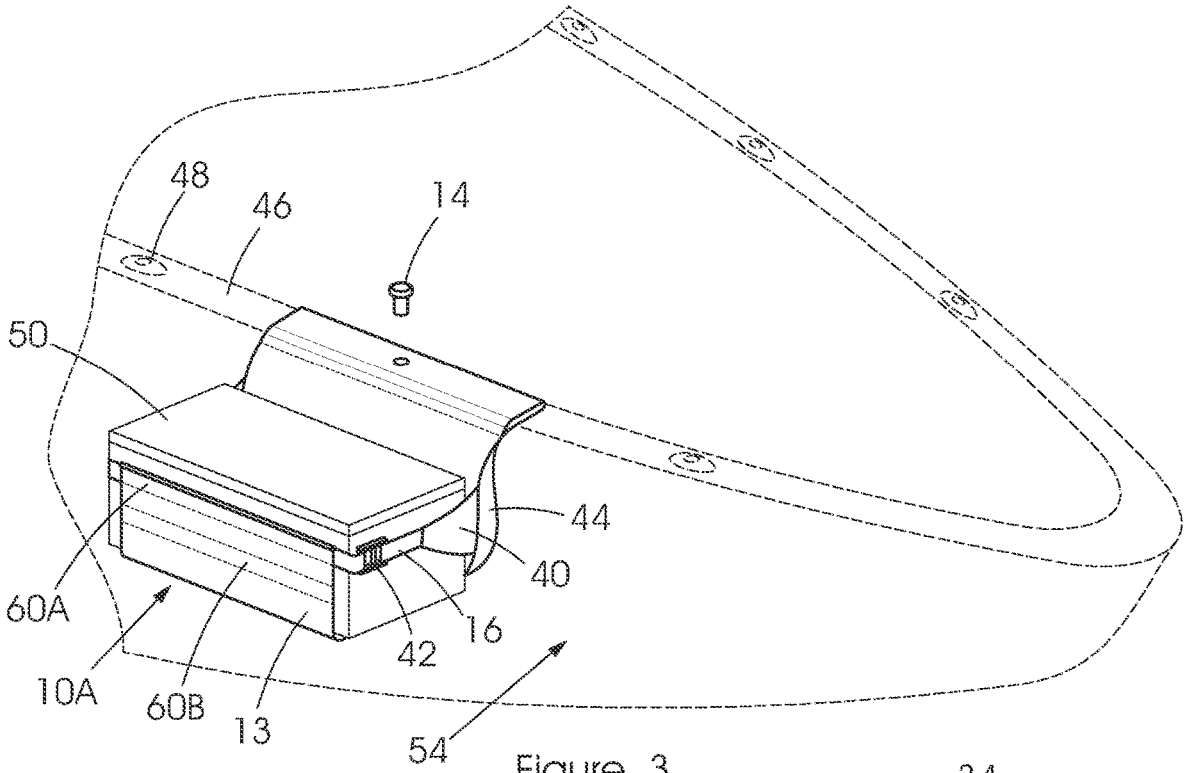
FIG. 3 illustrates diagrammatically and in perspective the storage device of FIG. 2B engaged to the boat.

A cushioning device 18, more particularly an inflatable bladder as depicted in FIG. 2B, forms part of the storage device.

The rectangular sheet 13 presents a first, or operatively upper surface 20, and an opposed second, or operatively under surface 22. The rectangular sheet is delimited by a first side 24, an opposed second side 26 and a pair of transversely opposed side edges, respectively designated 28A and 28B.

Along the first side 24, the sheet is looped to provide a first pocket 32. It is into this first pocket that a rigid gunwale mounting plate or plate 34 is positioned before the pocket is sewn closed to enclose the plate. The bar has a centrally positioned aperture 36 which positions in register with holes made through the pocket.

The harness 16, in this example, is a belt which attaches at each of its ends (38A, 38B) to a respective flap extension 40 forming part of the respective side edge (28A, 28B). The belt has a cam buckle 42 to length adjust a circumscribing section of the belt.

The rectangular sheet is formed with a second pocket 44 which is has a side or a top opening through which the inflatable bladder 18 is inserted into the pocket. The second pocket has a strip of Velcro (not shown) along the opening that is used to secure the opening closed once the bladder is inserted. Should the bladder be punctured and in need of repair, the pocket is opened along the opening with ease to remove the bladder for repair. As illustrated in FIG. 2B, the inflatable bladder, once inflated, takes on a wedge shape.

The holder includes a spongy pad 45 engaged to, or integral with, the sheet 13. The pad is positioned to protrude from the under, and now rear, surface 22 between the bladder containing second pocket 44 and a side of the boat when the holder is in the operative position, engaged to the boat (see FIG. 4). In this position, the pad minimises lateral movement of the harness relatively to the side of the boat and also prevents scratching of the boat hull which may occur if the harness is made of a relatively stiff webbing.

As shown in FIG. 2A, the holder 12 hangs loosely in an inoperative position. Inoperative, the holder too can be folded for storage. However, when the storage device 10A is needed to be used, the holder is attached to the boat by positioning the mounting plate on the boat's gunwale 46, over a rod holding recess 48, a series of which is typically found formed into the gunwale. With the aperture 36 of the plate in register with recess 48, the attachment element 14, which is a plug in this example. The plug has a generally tubular body, adapted to friction fit, at least partially, into a respective rod holding recess 48.

Once attached, the body 13 of the holder 12 falls limply over the side of the boat 12. The body is brought into the operative position by placing a box-like item 50, such as cooler box, over the body with a boat-hull side surface 52 of the box adjacent a side 54 of the boat. Then, the sheet body 13 is pulled up to cover the outside surface 56 of the box from the second side 26.

To hold together the assembly, the circumscribing section of the belt 16 is passed around the box-containing holder to contact the second surface 22 of the body at or adjacent the second side 26. The second side can be formed with a ridge or rim 58 to prevent the belt from sliding off the body (see FIG. 2B). Preferably, a part of the circumscribing section of the belt passes through either an upper hem 60A or, spaced therefrom, a parallel lower hem 60B (see FIG. 3), each made in the in the second side. Choice as to which of the parallel hems to pass the belt through will depend upon the size of the cooler box 50. For a smaller box and a larger box, the lower hem and upper hem respectively will be used.

Now in the operative position, the cooler box 50 is secured within the confines of the holder 12 by actuating the cam buckle to reducing the length of the circumscribing section of the belt thereby pulling the box towards the boat's hull to secure the assembly.

Figure 4:
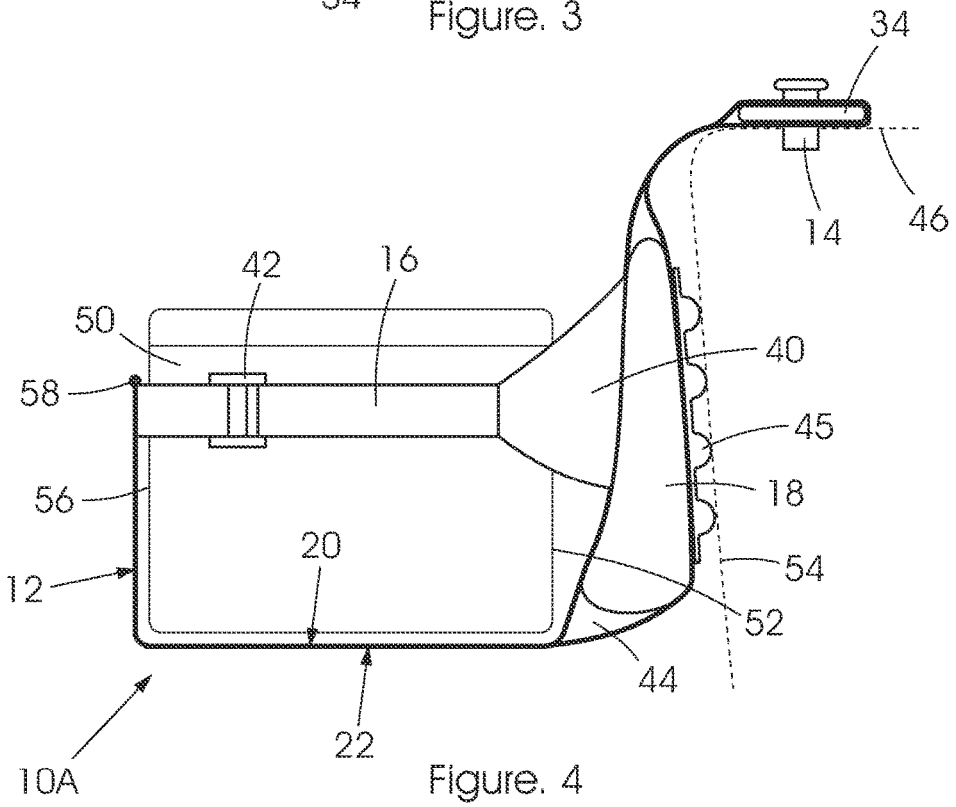
FIG. 4 is a view from a side of the storage device of FIG. 3.

To ensure that the box 50 contained within the holder is optimally positioned with a top side in near horizontal orientation, the inflatable bladder 18 is used, on inflation, to expand into the complementary wedge-shaped void between the second surface 22 of the holder 12 and the hull wall 54 of the boat 11. This operation is best shown in FIG. 4.

Figure 5:
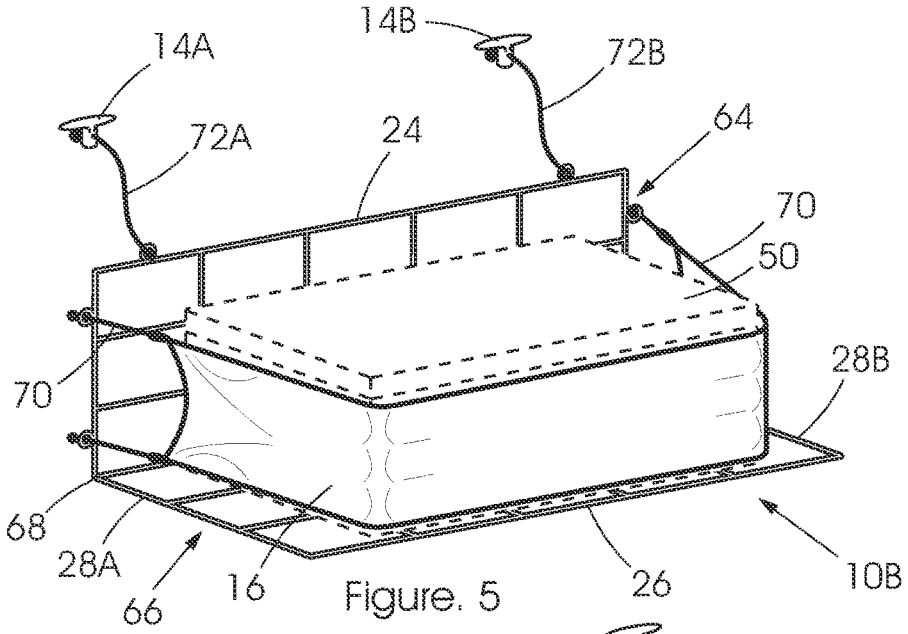
FIG. 5 illustrates, in perspective, the storage device in accordance with a second embodiment of the invention.
Figure 6A:
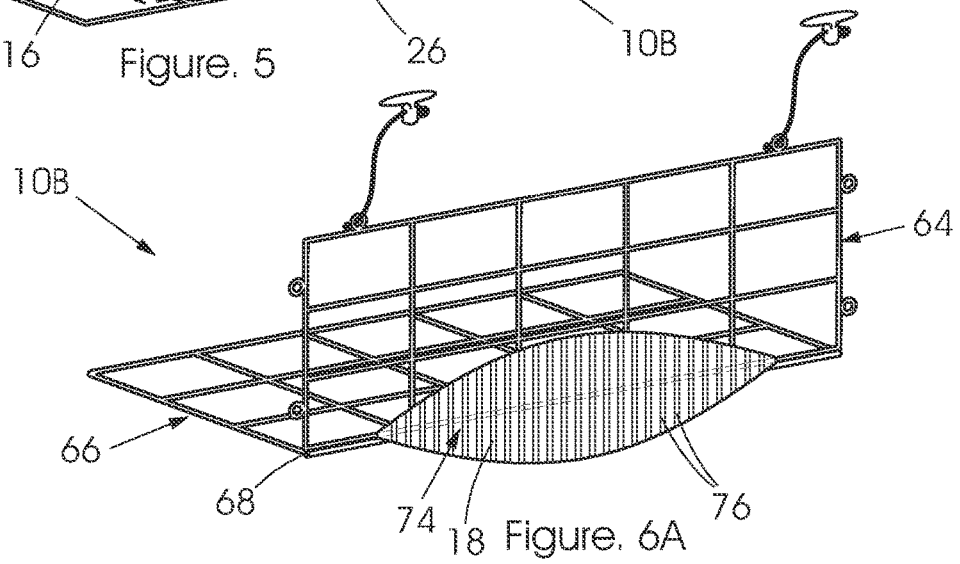
FIGS. 6A and 6B illustrate, in perspective, the storage device of the second embodiment in an inoperative (FIG. 6A) and operative (FIG. 6B) position.
Figure 6B:
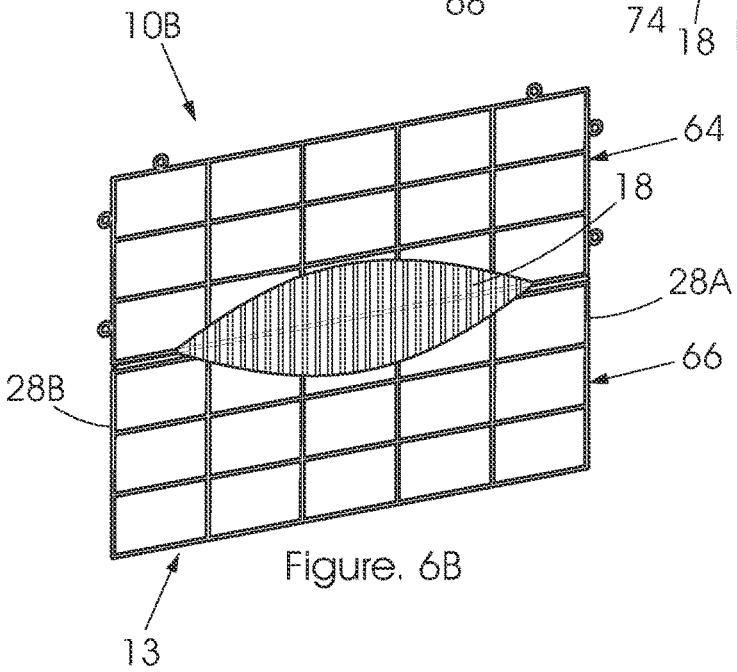

In describing a second embodiment 10B of the invention, with reference to FIGS. 5 and 6B, like features bear like designations.

The storage device 10B of this second embodiment differs, in essence, from the first embodiment 10A, in that the holder 12 has a rigid rectangular body 13 comprised of a first or bracing panel 64 and a second or base panel 66, joined at an axis 68. Each panel (64, 66) is a wire-mesh panel.

The harness 16 in this embodiment is depicted as stretchable fabric panel which is secured to the side edges (28, 30) of the bracing panel 64 with a plurality of ties 70, pairs of which secure each end of the fabric panel to the bracing panel. With the ties secured, pulling on the fabric panel, the fabric panel will securely embrace the cooler box 50 and hold the cooler box against the bracing panel. However, the belt and cam buckle of the first embodiment is equally functional with this embodiment.

The storage device 10B is attached to the boat similarly to the first embodiment. The attachment element includes a pair of plugs, respectively designated 14A and 14B, and a pair of length adjustable suspension cords, respectively designated 72A and 72B. Each cord is attached, at opposed ends, to a respective plug and to the bracing panel 64 at the first side 24. Each plug inserts into a respective rod holding recess 48.

In the inoperative position, the panels (64, 66) can be folded over one another about the axis 68. In the operative position, the second panel is rotated about the axis to project perpendicularly from the first panel as illustrated in FIG. 5. The second panel is locked in this operative position by actuating a locking mechanism (not shown) which prevents rotation about the axis allowing the second panel to drop away.

The second panel provides a platform onto which the cooler box 50 can be placed for storage overboard. If needs be, the level of the platform can be adjusted by extending or shortening the length of each cord 72.

This embodiment 10B has a cushioning device 18 which is a non-slip pad which is attached to a panel of the holder, preventing the device 10B from moving laterally along the side 62 of the boat 12 and also prevents the rigid body of the holder 12 from marking or scratching the boat hull 62. The pad has a boat-facing flat surface 74 which is made of a rubber-like material formed with a plurality of ridges 76. This feature is functionally analogous to the spongy pad 45 of the previous embodiment in that these ridges resistively engage the boat side preventing movement and damage. Alternatively or additionally, the cushioning device can be an inflatable device as is the case with the first embodiment.

The invention claimed is:

1. A device for overboard storage from a pleasure craft of an item which device includes a holder which has a first surface and a second surface and which is defined between a first side, a second side and a pair of side edges and which is moveable from an inoperative position to an operative position, an attachment element which is engaged to the holder at or towards the first side and which is adapted to attach the holder to an edge of the pleasure craft, a harness which is engaged to the holder, wherein the harness is adapted to circumscribe the item, when the holder is in the operative position and the item engages the holder on the first surface, to retain the item on or within the holder, and an inflatable device which is adapted to take on a wedge-shaped configuration when inflated and which is engaged to, or integral with, the holder in a position to provide a cushion between the second surface and a side wall of the pleasure craft by filling a complementary shaped void between the holder and the side wall.

2. The device according to claim 1, wherein the holder has a flexible body comprised of a sheet or a net of a flexible material.

3. The device according to claim 2 wherein the holder includes a rigid mounting element to which the attachment element engages to attach the holder to the edge of the pleasure craft.

4. The device according to claim 3 wherein the rigid mounting element extends along the first side.

5. The device according to claim 4 wherein the holder is formed with a pocket along the first side for receiving the rigid mounting element.

6. The device according to claim 1 wherein the harness is a length adjustable belt and buckle.

7. The device according to claim 6 wherein each end of the harness engages a respective side edge of the holder.

8. The device according to claim 1 wherein the attachment element is at least one plug which is adapted to engage a respective rod holder aperture.

* * * * *